United States Patent [19]

Heine et al.

[11] Patent Number: 4,601,626

[45] Date of Patent: Jul. 22, 1986

[54] ARRANGEMENT FOR SWINGING AN ATTACHMENT HOLDER FOR THE EQUIPMENT OF A HYDRAULIC EXCAVATOR

[75] Inventors: Franz Heine; Manfred Kowalewski, both of Dortmund, Fed. Rep. of Germany

[73] Assignees: O&K Orenstein; Koppel Aktiengesellschaft, both of Berlin, Fed. Rep. of Germany

[21] Appl. No.: 531,126

[22] Filed: Sep. 9, 1983

[30] Foreign Application Priority Data

Sep. 14, 1982 [DE] Fed. Rep. of Germany ..... 3234020

[51] Int. Cl.[4] ..... E02F 3/32

[52] U.S. Cl. ..... 414/687; 74/103; 212/245; 414/695

[58] Field of Search ..... 414/686, 687, 694, 695; 212/223, 245; 74/103; 173/38

[56] References Cited

U.S. PATENT DOCUMENTS

| | | | |
|---|---|---|---|
| 3,452,882 | 7/1969 | Noller et al. | 212/245 |
| 3,717,269 | 2/1973 | Schaef | 414/694 |
| 4,261,684 | 4/1981 | Norton et al. | 74/103 X |
| 4,358,240 | 11/1982 | Shumaker | 414/694 |
| 4,378,193 | 3/1983 | Schaef | 414/687 X |

FOREIGN PATENT DOCUMENTS

| | | | |
|---|---|---|---|
| 257999 | 5/1963 | Australia | 414/687 |
| 1634994 | 5/1974 | Fed. Rep. of Germany . | |

*Primary Examiner*—Donald W. Underwood
*Attorney, Agent, or Firm*—Martin A. Farber

[57] ABSTRACT

Arrangement for swinging an attachment holder for the equipment of a hydraulic excavator around an axis perpendicular to the platform plane of the upper carriage, in a working direction parallel to the longitudinal direction of the excavator chassis. The lower part of the boom is vertically swingably fastened to the attachment holder which in turn is pivoted to the upper carriage by two radial links which are mounted at each end for turning around a vertical axis. The upper carriage is pivoted to the chassis. Furthermore the attachment holder is operatively connected to an active setting member. It is the pivoting of the carriage relative to the chassis together with the pivoting of the attachment holder relative to the carriage which enables the movement of the attachment holder in a working direction parallel to the longitudinal direction of the excavator chassis.

9 Claims, 4 Drawing Figures

ARRANGEMENT FOR SWINGING AN ATTACHMENT HOLDER FOR THE EQUIPMENT OF A HYDRAULIC EXCAVATOR

BACKGROUND

The present invention relates to an arrangement for swinging an attachment holder for the equipment of a hydraulic excavator, in general, and to a device for swinging an attachment holder for the equipment of a hydraulic excavator around an axis perpendicular to the platform plane of the upper carriage, in a working direction parallel to the longitudinal direction of the excavator chassis, in particular.

The use of hydraulic excavators, particularly backhoes or those having dipper shovels, frequently involves the work of digging ditches. The excavators must be able to perform such work not only when the axis of the ditch coincides with the longitudinal axis of the chassis of the hydraulic excavator, but also in the event that excavation is to be effected parallel thereto, for example alongside of walls or roads. Another requirement is that the planes of the sidewalls of the excavated ditches be vertical. Finally, the bottom of the ditches must be within a range of selectable levels.

PRIOR ART

A mobile shovel excavator is already known (German Federal Republic Pat. No. 1 634 994) which has an upper carriage which is turnable on a chassis around a vertical axis. An attachment holder for an excavator boom is mounted on the upper carriage and is swingable to both sides around a vertical axis from its position parallel to the longitudinal axis of the upper carriage, the attachment holder being limited to an angular range of swing of about 45° to each side and being adapted to be locked within the range of swing by means of a setting member.

Such a mounting of the attachment holder of the excavator boom around a vertical axis, particularly when large pulling power is required for the excavation of ditches, tends to detrimentally load the joint so that high wear of the joint axle and finally instability result.

SUMMARY OF THE INVENTION

The object of the invention with an arrangement of the type described in the introductory paragraph is to provide a more favorable mounting and consequently a more advantageous loading of the swing device for the excavator equipment, the swing device comprising an attachment holder and two radial links.

According to the present invention with the aforementioned arrangement the boom lower part (3) is vertically swingably fastened to the attachment holder (7) which in turn is pivoted to the upper carriage (2) by means of two radial links (12, 13). These radial links are mounted at each of their end points (8–11) for turning around a vertical axis, the upper carriage is pivoted to the chassis, and furthermore an active setting member 16 is connected to the attachment holder.

The advantage of the invention is that the forces which act on the swing device of the excavator equipment, and therefore on the attachment holder and the radial links between the boom lower part and the upper carriage, are distributed over larger surfaces and are therefore easier to control. The angular range for the equipment which operates parallel to the longitudinal direction of the hydraulic excavator therefore is not restricted.

In order to swing the upper part of the boom and consequently the excavator equipment, the active setting member (16) is provided between the attachment holder and the upper carriage of the excavator in addition to the radial links. This active setting member may be a hydraulic cylinder.

During prolonged operation of the hydraulic excavator at a position of predetermined constant parallel displacement of the direction of working from the longitudinal axis of the chassis of the hydraulic excavator, it is advantageous to provide mechanical elements to be able to free the setting member from load. The mechanical elements may comprise, for example, a lock and bolt which lock the predetermined selected position of the equipment. The mechanical elements can lock the attachment holder (7) passively in any selected angular position.

BRIEF DESCRIPTION OF THE DRAWINGS

With the above and other objects and advantages in view, the present invention will become more clearly understood in connection with the detailed description of a preferred embodiment, when considered with the accompanying drawings, of which.

DETAILED DESCRIPTION OF THE PREFERRED EMBODIMENT

Figure 1:
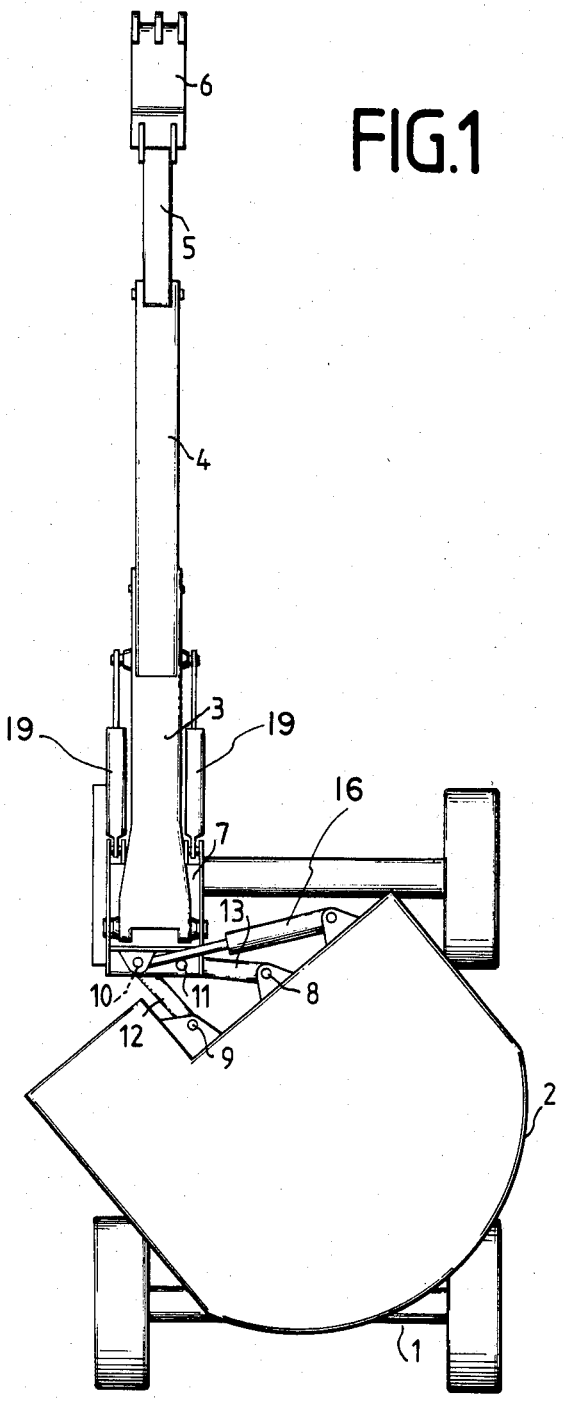
FIG. 1 is a top plan view of a hydraulic excavator with the equipment operating in a position displaced to one side from the longitudinal axis of the excavator at an end position thereof in operation parallel to the longitudinal axis.

FIG. 1 shows a hydraulic excavator comprising a chassis having a lower carriage 1 and an upper carriage 2 pivotally mounted on the lower carriage about a vertical pivot axis (not shown). Conventional excavator equipment, having a boom lower part 3, a boom upper part 4, an excavator rod 5 and a digging tool 6 operatively connected to each other, is operatively pivoted to the upper carriage 2. The boom lower part 3 is fastened for vertical (up and down) swinging to an attachment holder 7 which in turn is connected to the upper carriage 2 by two radial links 12 and 13. The radial links are arranged with their longitudinal axes at an oblique acute angle relative to each other and are turnable at their end points (pivot axes) 8, 9, 10, 11 around vertical axes.

Figure 4:
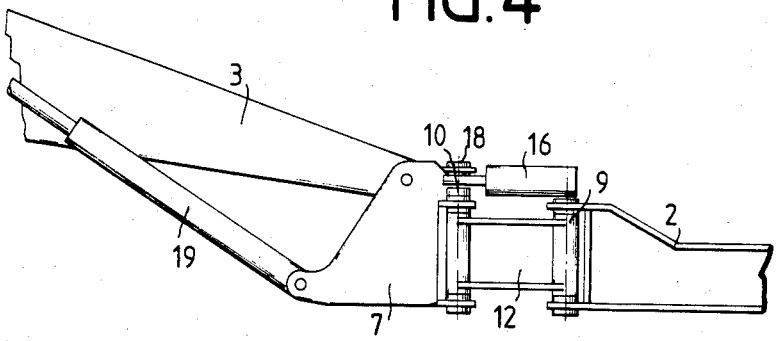
FIG. 4 is a view taken along the lines A-B of FIG. 3.

As shown in FIGS. 1 and 4 hydraulic cylinders 19 are pivotally connected by means of horizontal pivot axes to the boom lower part 3 and to the attachment holder 7 for the vertical (up and down) swinging operation of the boom lower part 3 which in turn is pivotally connected by means of horizontal pivot axes to the attachment holder 7. Other arrangements may also be provided for the up and down swinging of the boom.

By means of the geometrical connection of the end points 8, 9 as the base line of a scalene-angled "rectangle" (more precisely a quadrilateral), the radial links 12, 13 (as the sides of the "rectangle") swing the connection of the end points 10, 11 (as the opposite side of the rectangle).

Figure 2:
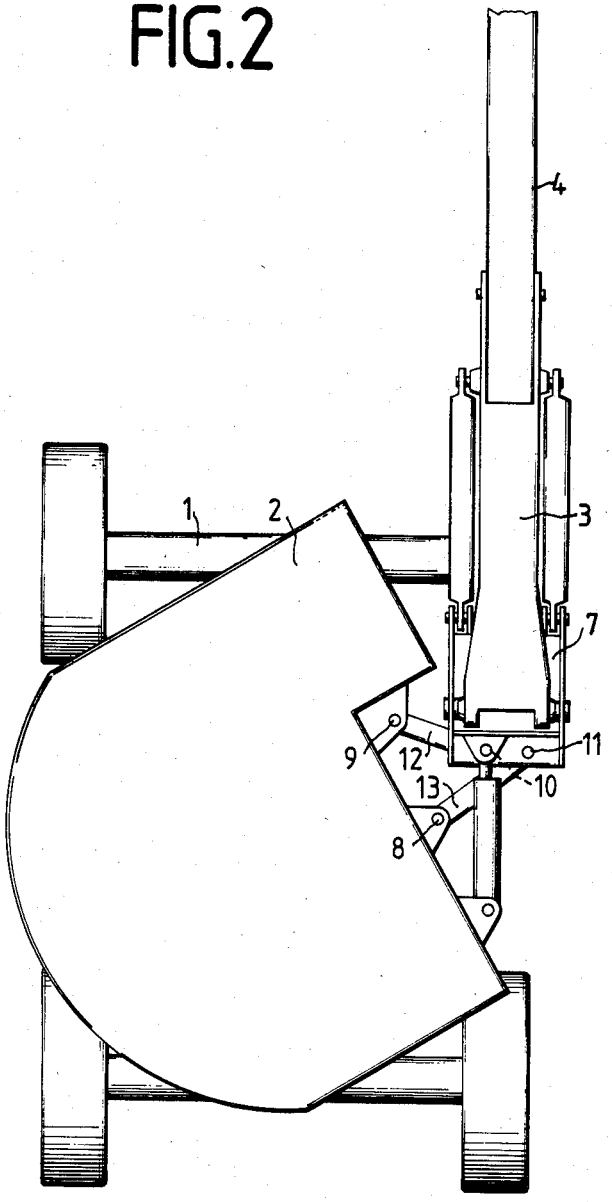
FIG. 2 shows the hydraulic excavator of FIG. 1 with the equipment operating in a position displaced to the opposite side of the longitudinal axis of the excavator, in the opposite end position of its operation parallel to the longitudinal axis.

FIG. 2 shows the hydraulic excavator with the equipment operating in a position displaced to the right side of the longitudinal axis of the excavator parallel to the longitudinal axis.

Figure 3:
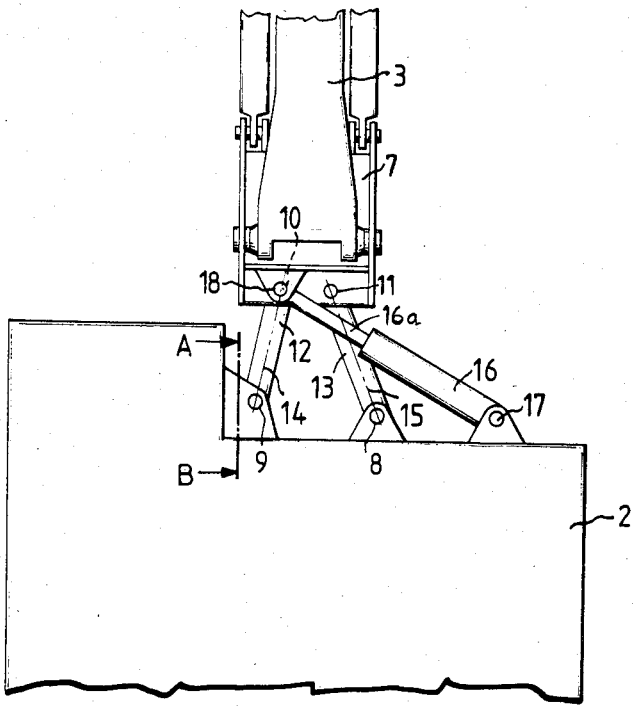
FIG. 3 is a broken away view of FIGS. 1 and 2 but showing the swing device in its position aligned with the longitudinal axis of the excavator.

In FIG. 3 there can be noted, in particular, the individual parts of the swing device for the equipment of the hydraulic excavator. The longitudinal axes 14 and 15 of the radial links 12 and 13 are shown forming an acute angle with respect to each other.

For actively effecting the parallel swinging operation of the attachment holder 7 an active setting member 16 is connected pivotally to and preferably between the attachment holder 7 and the upper carriage 2. The setting member 16 is pivotally mounted at one end at the point 17 on the upper carriage 2 and at the other end around the vertical axle 18 which is mounted in the attachment holder 7.

The setting member 16 may be a power actuator such as a hydraulic cylinder, the force of which acts, by change of the effective length of its piston rod 16*a*, on the axle 18 and consequently on the attachment holder 7. The upper carriage 2 may be turned by conventional means (not shown). In this manner by actuation of the hydraulic cylinder 16 the attachment holder 7 and the boom 3 connected thereto describe a swinging movement with which movement there is associated a simultaneously corresponding turning of the upper carriage 2 about its vertical pivot axis when the excavator equipment (boom 3, etc) is moved parallel to the longitudinal axis of the chassis. This described swinging movement of the attachment holder 7 is essentially a swinging substantially about the vertical pivot axis of the upper carriage 2, yet while maintaining a parallel orientation of the attachment holder 7 parallel to the longitudinal axis of the chassis by means of the setting member 16.

From FIG. 4 which is a side view of the arrangement of FIG. 3 along the line A-B, it can be noted that the active setting member 16 which as described, displaces the attachment holder 7 and the boom 3 is also pivotally mounted on the attachment holder 7. The axis or axle 18 at the pivot point of the setting member 16 on the attachment holder 7 in this embodiment coincides coaxially with the axis of the pivot point 10 of the link 12 on the attachment holder 7. This is not a requirement for the present invention in every arrangement thereof.

While we have described one embodiment of our invention it is to be understood that this embodiment is given by example only and not in a limiting sense.

We claim:

1. A device for enabling swinging an attachment holder of a hydraulic excavator around an axis perpendicular to a platform plane of an upper carriage of the excavator, in a working direction at a fixed angle relative to a longitudinal direction of a chassis of the excavator, the excavator comprising a boom having a boom lower part upwardly and downwardly swingably fastened to the attachment holder, the device comprising first means for pivotally mounting the attachment holder to the upper carriage, second means for pivotally mounting said upper carriage to the chassis for rotation about a vertical axis, said first means comprises two radial links which are pivotally mounted adjacent each end of said links for turning around a respective vertical axis, one of said vertical axes of each of said two links being spaced from each other on said attachment holder, and the other one of said vertical axes of each of said two links being spaced from each other on said upper carriage, and an active setting member having spaced apart end portions, one of said spaced apart end portions being directly pivoted to said attachment holder and the other of said spaced apart end portions being directly pivoted to said upper carriage of the excavator.

2. The device for swinging an attachment holder according to claim 1, wherein said setting member is pivotally connected to said attachment holder at a pivot axis which is coaxial to one of said two vertical axes of said links.

3. The device for swinging an attachment holder according to claim 1, wherein said setting member is a hydraulic cylinder.

4. The device for swinging an attachment holder according to claim 1, wherein said upper carriage is pivotally mounted on the chassis for rotation about said first-mentioned vertical axis, such that upon rotation of said upper carriage and controlled actuation of said setting member said links pivot cooperatively about their respective axes such that said attachment holder moves in a position parallel to said fixed angle relative said longitudinal axis of said chassis.

5. The device for swinging an attachment holder according to claim 1, wherein said links are inclined at an acute angle towards each other and form sides of a quadrilateral, the vertices of which are the pivotal vertical axes of the ends of said links.

6. The device for swinging an attachment holder according to claim 1, wherein said fixed angle is zero such that said working direction is parallel to the longitudinal direction of the chassis of the excavator.

7. A device for enabling swinging an attachment holder of a hydraulic excavator around an axis perpendicular to a platform plane of an upper carriage of the excavator, in a working direction at a fixed angle relative to a longitudinal direction of a chassis of the excavator, the excavator comprising a boom having a boom lower part upwardly and downwardly swingably fastened to the attachment holder, the device comprising first means for mounting the attachment holder to the upper carriage, second means for pivotally mounting said upper carriage to the chassis for rotation about a vertical axis, said first means comprises comprises exclusively two rigid links, each of said links is pivotally mounted adjacent each end of said each link for turning around a separate vertical axis, one of said vertical axes of each of said two links being spaced from each other on said attachment holder, the other one of said vertical axes of each of said two links being spaced from each other on said upper carriage, and an active setting member having spaced apart end portions, one of said spaced apart end portions being directed pivoted to said attachment holder of the excavator and the other of said spaced apart end portions being directly pivoted to said upper carriage of the excavator.

8. The device for swinging an attachment holder according to claim 1, wherein each of said links is a single elongated link and pivotally connected adjacent said ends thereof on said attachment holder and said upper carriage about their respective axes respectively.

9. The device for swinging an attachment holder according to claim 8, wherein said active setting member is a hydraulic cylinder.

* * * * *